US006823788B2

(12) United States Patent
Malkic

(10) Patent No.: US 6,823,788 B2
(45) Date of Patent: Nov. 30, 2004

(54) CYLINDER COVERING AND METHOD OF ATTACHING A CYLINDER COVERING IN A PRINTING PRESS

(75) Inventor: Dominique Malkic, Verneuil-en-Halatte (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/437,590

(22) Filed: May 14, 2003

(65) Prior Publication Data

US 2003/0213390 A1 Nov. 20, 2003

(30) Foreign Application Priority Data

May 16, 2002 (DE) ..... 102 22 225

(51) Int. Cl.[7] ..... B41F 13/10
(52) U.S. Cl. ..... 101/378; 101/415.1
(58) Field of Search ..... 101/378, 415.1, 101/486, 409

(56) References Cited

U.S. PATENT DOCUMENTS

| | | | | | |
|---|---|---|---|---|---|
| 3,295,443 | A | * | 1/1967 | Devon | 101/415.1 |
| 3,489,085 | A | | 1/1970 | Kirkpatrick | 101/415.1 |
| 4,620,482 | A | | 11/1986 | Fischer | 101/415.1 |
| 4,648,318 | A | | 3/1987 | Fischer | 101/415.1 |
| 5,088,408 | A | * | 2/1992 | Philpot | 101/415.1 |
| 5,410,964 | A | * | 5/1995 | Koelsch | 101/378 |
| 5,553,543 | A | * | 9/1996 | Takahashi et al. | 101/409 |
| 5,562,039 | A | * | 10/1996 | Fox | 101/486 |
| 5,613,440 | A | | 3/1997 | Rau | 101/415.1 |
| 5,720,212 | A | * | 2/1998 | Kirkpatrick | 83/659 |
| 5,758,560 | A | * | 6/1998 | Fiscus | 83/659 |
| 5,916,346 | A | * | 6/1999 | Neal | 83/659 |
| 5,934,194 | A | | 8/1999 | Puschnerat et al. | 101/375 |
| 6,073,558 | A | * | 6/2000 | Jones | 101/415.1 |
| 6,129,018 | A | * | 10/2000 | Koppelkamm | 101/415.1 |
| 6,647,849 | B2 | * | 11/2003 | Jones | 83/659 |
| 2003/0101886 | A1 | * | 6/2003 | Rauh | 101/415.1 |

FOREIGN PATENT DOCUMENTS

| | | |
|---|---|---|
| DE | 4415683 | 11/1995 |
| EP | 1072434 | 1/2001 |
| GB | 1458870 | 12/1976 |
| WO | 8901866 | 3/1989 |

* cited by examiner

*Primary Examiner*—Eugene H. Eickholt
(74) *Attorney, Agent, or Firm*—Davidson, Davidson & Kappel, LLC

(57) ABSTRACT

A cylinder covering (10) is described, having a lateral edge reinforcement (12), which is received partially overlapping on the cylinder covering (10), the cylinder covering (10) having an upper side (14) as the printing side, which is distinguished in that the lateral edge reinforcement (12), on the part (16) not overlapping with the cylinder covering (10), has at least one projection (18) having a projection terminus (20) on a lateral surface, which faces toward the upper side (14) of the cylinder covering, of the lateral edge reinforcement (12), the perpendicular from the projection terminus (20) on the plane of the overlapping part of the cylinder covering (10) running at least partially outside or precisely on the contour of the lateral edge reinforcement (12). Furthermore, a method is described of receiving a cylinder covering (10), which is provided on at least one first lateral edge with a lateral edge reinforcement (12), on a cylinder (24) in a printing press, the cylinder (24) having a narrow cylinder channel (26) and at least one clamping device (28) having a holding slot (30) for the cylinder covering (10).

13 Claims, 2 Drawing Sheets

CYLINDER COVERING AND METHOD OF ATTACHING A CYLINDER COVERING IN A PRINTING PRESS

Priority to German Patent Application No. 102 22 225.8, filed May 16, 2002 and hereby incorporated by reference herein, is claimed.

BACKGROUND INFORMATION

The present invention relates to a cylinder covering having a lateral edge reinforcement, which is received partially overlapping on the cylinder covering, the cylinder covering having an upper side as the printing side. Furthermore, the present invention relates to a method of receiving a cylinder covering, which is provided on at least one first lateral edge with a lateral edge reinforcement, on a cylinder in a printing press, the cylinder having a narrow cylinder channel and at least one clamping device having a holding slot for the cylinder covering.

Cylinder coverings, such as rubber printing blankets, printing forms, plates having special surface properties, or the like, have been used in printing technology for a considerable length of time. While sleeve-shaped cylinder coverings are pulled over the cylinder essentially in the direction along the cylinder axis, flat cylinder coverings are spread curved over at least a part of the surface of the receiving cylinder and attached using one or more clamping devices, which exert forces in the tangential and radial directions of the surface on the part of the cylinder covering spread over the cylinder surface. In order to be able to use the largest possible surface for a given radius and given height of the cylinder, it is advantageous to position the clamping device(s) in the interior space of the cylinder and feed the edges of the cylinder covering through a cylinder channel, which is as small or narrow as possible and runs essentially parallel to the cylinder axis, to the clamping devices for attachment. An attachment element of the species described is disclosed, for example, in U.S. Pat. No. 4,648,318. Cylinders of this type are also referred to as mini-gap cylinders.

Typical, commonly used flat cylinder coverings have a layered construction, one side, the upper side, being referred to as the printing side. The cylinder covering is received on a cylinder in a printing press or a machine which processes materials to be printed in such a way that the upper side lies outwardly.

A cylinder covering in the form of a rubber printing blanket is described in European Patent Application No. 1 072 434 A1, for example. The rubber printing blanket has at least one elastomer layer as the printing side, a compressible layer, and a reinforcement layer. In order to allow the lateral edges of the rubber printing blanket to be received in a clamping device of a mini-gap cylinder, a cylinder having a narrow cylinder channel, the thickness of the rubber printing blanket is implemented as tapered on the sides of the relevant lateral edges in comparison to its thickness at a point which is located over the surface of the cylinder after the rubber printing blanket is spread out. A lateral edge to be received may be provided with a lateral edge reinforcement for stiffening.

A further, multilayered rubber printing blanket is known from U.S. Pat. No. 5,934,194. A lateral edge reinforcement for stiffening is attached on the lower side, the side facing away from the printing side, of the rubber printing blanket, partially overlapping with the rubber printing blanket.

A rubber printing blanket having a lateral edge reinforcement for stiffening, which encloses the rubber printing blanket partially overlapping both its upper side and its lower side, is disclosed in U.S. Pat. No. 3,489,085. The lateral edge reinforcement is considerably thicker than the rubber printing blanket. For attachment, the lateral edge reinforcement is received in an anchoring element. On the part not overlapping with the rubber printing blanket, the contour of the lateral edge reinforcement has a concave recess having a curved shape. The purpose of this recess is to provide a clearance to an edge of the anchoring element when the lateral edge reinforcement is inserted therein.

Inserting the lateral edges of a cylinder covering through a narrow cylinder channel into a clamping device having a holding slot in the interior space of the cylinder represents a difficulty which is not to be underestimated and an often time-consuming activity. To equip the cylinder, one lateral edge having a lateral edge reinforcement must be inserted through the cylinder channel into the interior space of the cylinder and then into the holding slot of the clamping device. The holding slot is typically essentially exactly as wide as the lateral edge reinforcement to be received, whether this reinforcement is attached only on the lower side of the cylinder covering or enclosing both the upper side and the lower side of the cylinder covering. Even slight tilting hinders the manipulation of the cylinder covering.

If a lateral edge reinforcement which encloses the upper side and the lower side is provided, a tool, whose end may be supported on a lateral edge of the lateral edge reinforcement, may also advantageously be used for pushing in the lateral edge reinforcement, since the enclosing lateral edge reinforcement is significantly wider than the cylinder covering. Since the lateral edge of an enclosing lateral edge reinforcement overlaps with the cylinder covering in this case, however, there is the danger of damage to the cylinder covering.

BRIEF SUMMARY OF THE INVENTION

An object of the present invention is to make the manipulation of a cylinder covering during its attachment to a cylinder in a printing press easier.

According to the present invention, a cylinder covering having an upper side as a printing side has a lateral edge reinforcement, which is received partially overlapping on the cylinder covering. On the part not overlapping with the cylinder covering, the lateral edge reinforcement has at least one projection having a projection terminus on a lateral surface, which faces toward the upper side of the cylinder covering, of the lateral edge reinforcement, the perpendicular from the projection terminus to the plane of the overlapping part of the cylinder covering running at least partially outside or precisely on the contour of the lateral reinforcement. According to this representation, a positional plane of the lateral edge reinforcement attached to the cylinder covering, in particular a tangential plane on the lower side or upper side of the cylinder covering on the lateral edge provided with the lateral edge reinforcement, for example, is understood as the plane of the overlapping part of the cylinder covering.

In other words, according to the present invention the lateral edge reinforcement has, on its part which does not overlap the cylinder covering, a structure which is convex in relation to the part overlapping with the cylinder covering. This convex structure—having a partially non-convex, i.e., partially concave or partially straight contour—forms a projection which extends up to a projection terminus. The point of the contour which has an extreme position in relation to the projection is referred to as the projection terminus.

The projection advantageously forms a structure on the lateral surface of the lateral edge reinforcement on which a tool may be supported, in particular during the manipulation for receiving the cylinder covering on a cylinder in a printing press.

In a preferred embodiment, the cylinder covering is a rubber printing blanket. The projection may advantageously be implemented as hooked.

In an advantageous embodiment, the contour of the lateral edge reinforcement of the cylinder covering runs at least partially curved from the projection terminus in the direction toward the cylinder covering. In particular, the contour of the lateral edge reinforcement of the cylinder covering may have a concave shape from the projection terminus in the direction toward the cylinder covering. The concave shape may be uniform, progressive, or degressive. In a preferred embodiment, the projection is formed by a part of the lateral edge reinforcement which is curved in the direction of the upper side of the cylinder covering. The projection terminus may correspond to a point on a lateral edge of the lateral edge reinforcement of the cylinder covering.

In the method according to the present invention of receiving a cylinder covering, which is provided on at least one first lateral edge with a lateral edge reinforcement, on a cylinder in a printing press, the cylinder having a narrow cylinder channel and at least one clamping device having a holding slot for the cylinder covering, the lateral edge reinforcement on the first lateral edge of the cylinder covering is first inserted through the cylinder channel into the interior space of the cylinder. A part of the lateral edge reinforcement is then inserted into the holding slot of the clamping device. In order to push the lateral edge reinforcement into the holding slot, a tool is used. In this case, the tool is supported on a part of the lateral edge reinforcement which does not overlap with the cylinder covering. In particular, the tool may be supported on a projection on a lateral surface of the lateral edge reinforcement which faces toward the upper side of the cylinder covering.

A corresponding method may be used for a second lateral edge having a lateral edge reinforcement. In particular, the cylinder covering may be a cylinder covering according to the present invention, as is disclosed in the present description.

It is especially advantageous if the tool has an elastic shape or is flexible, since a clamping device is frequently positioned below the cylinder surface, but not on a direct radial path along the azimuth of the cylinder channel viewed outward from the cylinder axis. The tool may be curved in the interior space of the cylinder covering as it is supported on the lateral edge reinforcement while the lateral edge reinforcement is pushed into the holding slot.

The method according to the present invention is especially advantageously usable for cylinders which are received in a printing unit of a web-fed rotary press. In a refinement for clamping devices having clamping shafts, in the method according to the present invention, the cylinder covering is also clamped around the circumference of the cylinder by rotating the clamping shaft in a clamping direction.

BRIEF DESCRIPTION OF THE DRAWINGS

Further advantages and advantageous embodiments and refinements of the present invention are represented on the basis of the following figures and their descriptions, in which.

DETAILED DESCRIPTION

Figure 1:
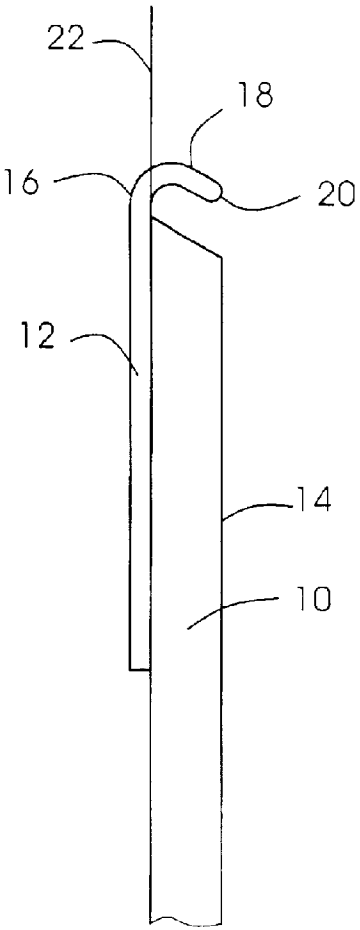
FIG. 1 shows a lateral view of a preferred embodiment of a cylinder covering having a lateral edge reinforcement according to the present invention.

FIG. 1 shows a side view of a preferred embodiment of a cylinder covering 10 according to the present invention, a rubber printing blanket, having lateral edge reinforcement 12. Cylinder covering 10, the rubber printing blanket, has an upper side 14, a printing side. Lateral edge reinforcement 12 is received partially overlapping on cylinder covering 10. On non-overlapping part 16, lateral edge reinforcement 12 has a projection 18 having projection terminus 20. Projection 18 is implemented as a hooked or grooved projection. Projection 18 of lateral edge reinforcement 12 may be made, for example, by bending a flat lateral edge of reinforcement 12. Projection terminus 20 then corresponds to a point on a lateral edge of lateral edge reinforcement 12.

The perpendicular from projection terminus 20 on plane 22 of the overlapping part of the lateral edge reinforcement runs outside the contour of lateral edge reinforcement 12. In other words, projection 18 has a concave contour, starting from projection terminus 20 along the course of the contour in the direction of cylinder covering 10, until the contour runs in a straight line. Projection terminus 20 does not project over the plane of surface 14. The side of cylinder covering 10 lying opposite the projection is beveled, so that the space formed by projection 18 and the side of cylinder covering 10 is accessible using a tool at an angle different from 90 degrees, an acute angle viewed from cylinder covering 10, to the plane 22 of the overlapping part.

In a preferred embodiment, lateral edge reinforcement 12 has a thickness of approximately 0.5 cm, so that cylinder covering 10, together with lateral edge reinforcement 12, is approximately 2.2 cm thick. Projection 18 is approximately 1.9 cm long, and the total length of the lateral edge reinforcement, i.e. overlapping part and non-overlapping part 16 with projection 18, is approximately 13.5 cm. Cylinder covering 10 is beveled at an angle of approximately 60 degrees. Cylinder covering 10 is advantageously narrow even with lateral edge reinforcement 12, so that it may be attached to a cylinder having a very narrow cylinder channel, typically 4.0 to 5.0 cm wide. The printing-free region may be reduced to 5.2 cm in comparison with typical cylinders having approximately 7.2 cm of printing-free region. In other words, the printing length increases by 2 cm. In this way, it is possible to achieve the printing length of a standard format using a mini gap cylinder with its diameter reduced. As a consequence, it is possible, using an extended printing length, to save material to be printed in a commercially advantageous way.

Figure 2:
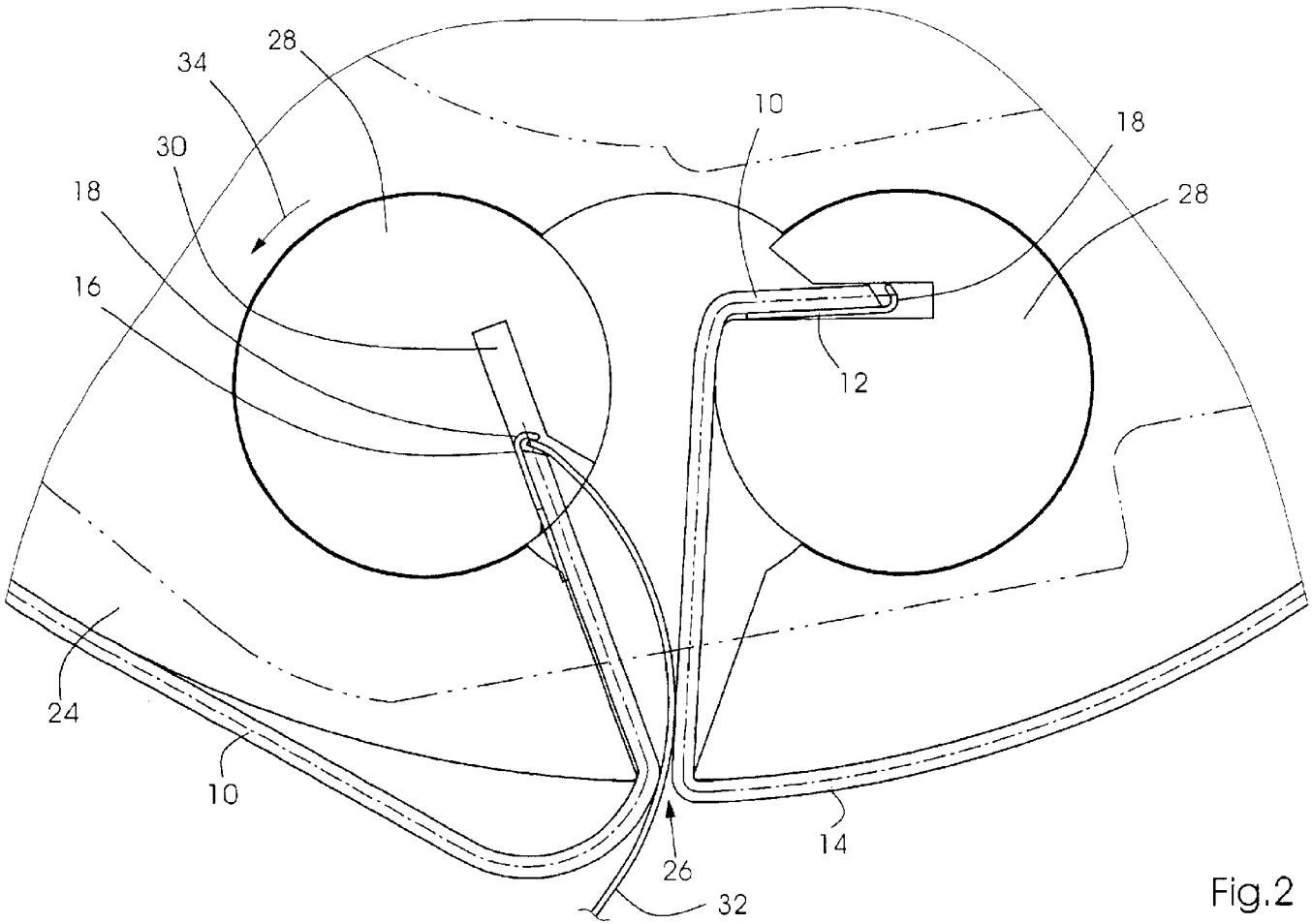
FIG. 2 shows two clamping devices inside a cylinder having a narrow cylinder channel, a cylinder covering according to the present invention being inserted into the holding slot of a first clamping device and a second clamping device being shown in the clamped state.

FIG. 2 is a representation of two clamping devices 28 inside a cylinder 24—shown in detail—having a narrow cylinder channel 26, a cylinder covering 10 according to the present invention being inserted into holding slot 30 of a first clamping device 28 and a second clamping device 28 being shown in the clamped state. The method according to the present invention for attaching a preferred embodiment of cylinder covering 10 according to the present invention will be explained on the basis of the left part of FIG. 2. With upper side 14, the printing side, lying outward, cylinder covering 10 is spread out over the surface of cylinder 24. First, lateral edge reinforcement 12 on the first lateral edge of cylinder covering 10 is inserted through cylinder channel

26 into the interior space of cylinder 24. Then, at least a part of lateral edge reinforcement 12 is inserted into holding slot 30 of clamping device 28. In order to push lateral edge reinforcement 12 and the first lateral edge of cylinder covering 10 into holding slot 30, a tool 32 is used, which has an elastic shape, so that holding slot 30, lying under the surface of cylinder 24, is reachable. Flexible tool 32 is supported on a part 16 of lateral edge reinforcement 12 which does not overlap with cylinder covering 10. The end of tool 32 engages in the space formed by projection 18, non-overlapping part 16 of lateral edge reinforcement 12, and the beveled side of cylinder covering 10, so that force may be transmitted, as a consequence of which the side of cylinder covering 10 provided with lateral edge reinforcement 12 is inserted into holding slot 30. Clamping device 24 includes a clamping shaft, so that cylinder covering 10 is clamped around the circumference by rotating the clamping shaft in clamping direction 34. A lateral edge of a cylinder covering 10 received and clamped in a clamping device 24 is shown in the right part of FIG. 2. This is the resulting final state of the method according to the present invention.

LIST OF REFERENCE NUMBERS

10 cylinder covering
12 lateral edge reinforcement
14 upper side
16 non-overlapping part
18 projection
20 projection terminus
22 plane of the overlapping part
24 cylinder
26 narrow cylinder channel
28 clamping device
30 holding slot
32 tool
34 clamping direction

What is claimed is:

1. A cylinder covering comprising:

a cylinder covering section having an upper side as the printing side; and a lateral edge reinforcement having a first part overlapping the cylinder covering section, the first part defining a plane, and a second part not overlapping the cylinder covering section and having a contour, the second part of the lateral edge reinforcement having at least one projection having a projection terminus on a lateral surface, the projection terminus facing toward the upper side of the cylinder covering, a perpendicular from the plane to the projection terminus running at least partially outside or precisely on the contour;

wherein the projection is formed by a part of the lateral edge reinforcement curved in the direction of the upper side of the cylinder covering.

2. The cylinder covering as recited in claim 1 wherein the cylinder covering is a rubber printing blanket.

3. The cylinder covering as recited in claim 1 wherein the projection is a hook.

4. The cylinder covering as recited in claim 1 wherein the contour of the lateral edge reinforcement runs at least partially curved from the projection terminus in a direction toward the cylinder covering.

5. The cylinder covering as recited in claim 4 wherein the contour has a concave shape from the projection terminus in the direction toward the cylinder covering.

6. The cylinder covering as recited in claim 1 wherein the projection terminus corresponds to a point on a lateral edge of the lateral edge reinforcement.

7. A method of receiving a cylinder covering provided on at least one first lateral edge with a lateral edge reinforcement on a cylinder in a printing press, the cylinder having a cylinder channel and at least one clamping device having a holding slot for the cylinder covering, the method comprising the following steps:

inserting the lateral edge reinforcement on the first lateral edge of the cylinder covering through the cylinder channel into an interior space of the cylinder;

inserting a section of the lateral edge reinforcement into the holding slot of the clamping device; and pushing the lateral edge reinforcement into the holding slot using a tool, the tool being supported on a part of the lateral edge reinforcement not overlapping with the cylinder covering.

8. The method as recited in claim 7 wherein the tool is supported on a projection on a lateral surface of the lateral edge reinforcement facing toward an upper side of the cylinder covering.

9. The method as recited in claim 7 wherein the tool has an elastic shape or is flexible.

10. The method as recited in claim 7 wherein the tool is curved in the interior space of the cylinder as the tool is supported on the lateral edge reinforcement and while the lateral edge reinforcement is pushed into the holding slot.

11. The method as recited in claim 7 wherein the cylinder is received in a printing unit of a web-fed rotary press.

12. The method as recited in claim 7 wherein the clamping device includes a clamping shaft, and the method further includes clamping the cylinder covering around the circumference of the cylinder by rotating the clamping shaft in a clamping direction.

13. The method as recited in claim 7 wherein the cylinder covering is a cylinder covering as recited in claim 1.

* * * * *